United States Patent [19]

Stendahl

[11] 4,257,478

[45] Mar. 24, 1981

[54] GASEOUS MEDIA HEAT EXCHANGER

[75] Inventor: Gunnar Stendahl, Linköping, Sweden

[73] Assignee: Stal-Laval Apparat AB, Sweden

[21] Appl. No.: 52,469

[22] Filed: Jun. 27, 1979

[51] Int. Cl.[3] ..... F28D 13/00

[52] U.S. Cl. ..... 165/104 F; 165/107 R

[58] Field of Search ..... 165/104 F, 107

[56] References Cited

U.S. PATENT DOCUMENTS

| | | | |
|---|---|---|---|
| 4,149,586 | 4/1979 | Phillips | 165/104 F X |

FOREIGN PATENT DOCUMENTS

| | | | |
|---|---|---|---|
| 2150577 | 4/1973 | Fed. Rep. of Germany . | |
| 2203964 | 5/1974 | France . | |
| 60147 | 6/1935 | Norway . | |
| 1500231 | 2/1978 | United Kingdom | 165/104 F |
| 567897 | 7/1972 | U.S.S.R. | 165/104 F |

*Primary Examiner*—Albert W. Davis

*Attorney, Agent, or Firm*—Watson, Cole, Grindle & Watson

[57] ABSTRACT

A heat exchanger for transmitting heat between gaseous media includes at least two chambers each partially filled with a solid transmitting medium in the form of pellets, granules or sand. A cold gaseous medium is injected through a first conduit into the bottom of a first of the chambers, and a hot gaseous medium is injected through a second conduit into the bottom of a second of the chambers, both media being injected at a rate for effecting fluidized beds of the transmitting media in the chambers. The chambers intercommunicate with one another via passageways extending from the first conduit so that transmitting media is transported from the first to the second chamber and from the second to the first chamber respectively by the first and second gaseous media to thereby effect an increase in temperature of the hot gaseous medium while passing through the transmitting media.

3 Claims, 5 Drawing Figures

GASEOUS MEDIA HEAT EXCHANGER

BACKGROUND OF THE INVENTION

This invention relates to a heat exchanger for the transmission of heat between gaseous media and includes at least two chambers each partially filled with a solid transmitting medium in the form of pellets, granules or sand.

There is a need for apparatuses for heat transmission between gaseous media whereby it is particularly desirable to utilize so-called regenerative heat exchange, that is, heat which is transmitted form a hot gaseous medium to an intermediate medium and from the latter to cold air, which is heated. The transfer can be made between gas and air or between air and air, and the transmitting medium must of course be capable of withstanding heat. Such devices have been so arranged, for example, whereby granules are injected into a container by means of a gas at a point from which they are permitted to fall by gravity through a channel into another point of injection for the gas from which they are intected into a second chamber which is in communication with the first chamber. The granules may thus be transported between these chambers while being regeneratively heat exchanged. The problem is to make such a device work efficiently and the present invention provides a solution to this problem and other problems associated therewith.

SUMMARY OF THE INVENTION

The heat exchanger according to the invention is so arranged whereby a first gaseous medium is injected into the bottom of one of two adjacent chambers each partially filled with a transmitting medium in the form of pellets, granules or sand. A second hotter gaseous medium is injected into the bottom of the other chamber, and both gaseous media are injected at a rate for effecting fluidized beds of the transmitting media in both chambers. Passageways extend outwardly of both the chambers and are respectively associated with conduits carrying the gaseous media into the other chamber, so that transmitting medium is transported from one chamber to the other and from the other to the one chamber whereby the colder gaseous medium is heated and the hotter gaseous medium is cooled while respectively passing through the transmitting media. This results in an efficient transfer of heat from the hotter medium to a granular bed compound and from the latter heat is transferred to cold air, which is heated. Such a heat exchanger can be made use of, for example, for the purpose of pre-heating for different forms of incineration devices.

DETAILED DESCRIPTION OF THE INVENTION

Figure 1:
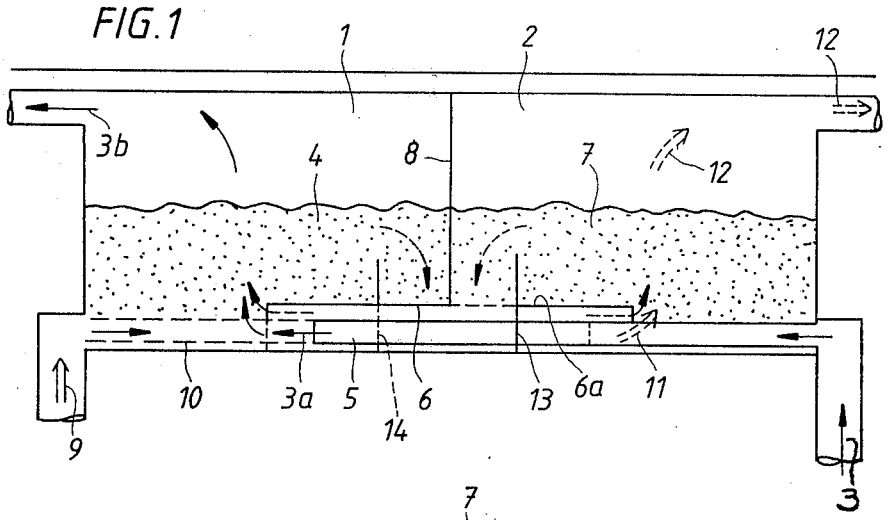
FIG. 1 schematically illustrates the heat exchanger in side elevation according to the invention as including at least two chambers disposed adjacent one another.

The heat exchanger shown in FIG. 1 includes means such as receptacles defining adjacent chambers 1 and 2 each partially filled with transmitting media 4 and 7, respectively, in the form of pellets, granules or sand. A cold gaseous medium or air is injected into the bottom of chamber 1 in the direction of arrow 3 through conduits 5. The geseous medium or air exits conduits 5 as shown by the arrow 3*a* at a rate for effecting a fluidized bed of the transmitting medium in chamber 1, i.e., at such a velocity causing the granules or the like to float. The air is heated by the transmitting medium 4 (as in a manner to be more fully described) and thereafter exits chamber 1 in the direction of the arrow 3*b*. The incoming air at 3 may, for example, have a temperature of 0° C. and the outgoing at 3*b* may have a temperature of 200° C.

Figure 2:
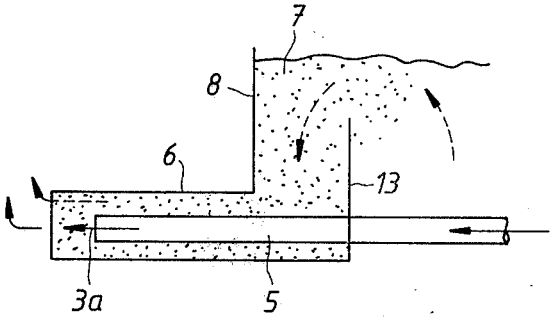
FIG. 2 is a detail view in enlarged scale schematically illustrating one of the ejector devices of the heat exchanger of FIG. 1.
Figure 5:
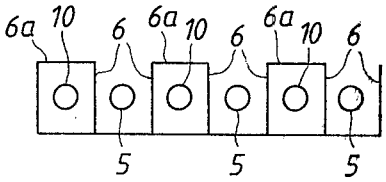

As more clearly shown in FIGS. 2 and 5, passageways 6 extend from chamber 2 and surround conduits 5, these passageways being open at their terminal ends beyond the ends of conduits 5 and open adjacent their inner ends directly into chamber 2 between a dividing wall 8 and a barrier wall 13.

Figure 3:
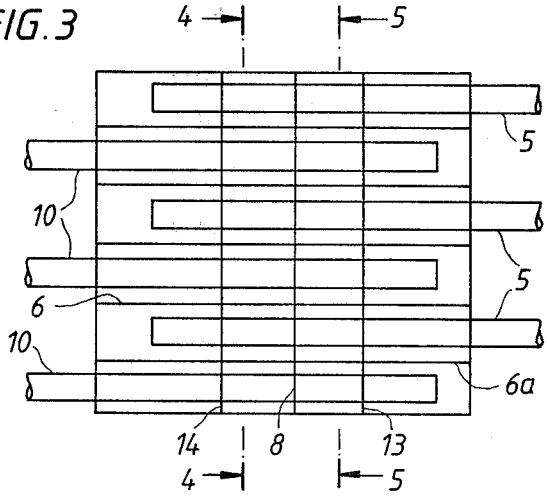
FIG. 3 is a plan view of ejector devices for transporting transmitting medium from both the first to the second chamber as well as from the second to the first chamber.
Figure 4:
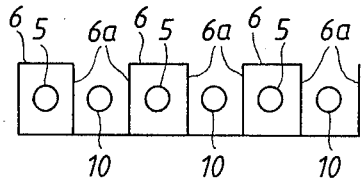
FIGS. 4 and 5 are respectively cross sectional views taken along the lines 4—4 and 5—5 of FIG. 3.

In the same manner, a hotter gaseous medium or air is injected in the direction of arrow 9 through conduits 10 into the bottom of chamber 2 and exits from the conduits as shown by arrow 11, passes through transmitting medium 7 whereupon it is cooled and then out through chamber 2 in the direction of arrows 12. This hotter gaseous medium or air exits conduits 10 at a sufficiently high velocity so as to maintain transmitting medium 7 floating in a so-called fluidized bed. Passageways 6*a* are similar to passageways 6 except they extend from chamber 1 and surround conduits 10 so as to terminate slightly beyond the terminal ends of conduits 10. These passageways open at their terminal ends into the bottom of chamber 1 between dividing wall 8 and a partition 14. FIGS. 3, 4 and 5 illustrate both sets of passageways 6, 6*a* relative to the respective conduits 5 and 10 so as to thereby effect intercommunication between chambers 1 and 2.

As the cold and hot gaseous media are injected respectively in the direction of arrows 3 and 9 through their conduits 5 and 10, the cold gaseous medium ejected from conduits 5 into transmitting medium 4 causes the granules or the like in chamber 1 to move in the direction of the dashed arrow between wall 8 and partitition 14 so as to transport transmitting medium 4 into passageways 6*a* so as to exit therefrom into the bottom of chamber 2. In a corresponding manner, the hot air exiting conduits 10 is injected into the bottom of chamber 2 and causes the granules or the like therein to move in the direction of the dashed arrow between wall 8 and partition 13 so as to be transported into the bottom of chamber 1 via passageways 6. Thus the cold gas or air is elevated in temperature when passing between arrows 3*a*, 3*b* through transmitting medium 4 which was heated by the hotter granules of transmitting medium 7 transported as aforedescribed from chamber 2 into chamber 1. Correspondingly, the hot gas or air when moving between arrows 11 and 12 through transmitting medium 7 is cooled by the colder granules of transmitting medium 4 which has been transported as aforedescribed from chamber 1 into chamber 2. And, it can be seen that in addition to the manner of transporting the transmitting media between the chambers, the cold gas exiting conduits 5 assists in the transport of transmitting medium 7 from chamber 2 to chamber 1, and the hot gas exiting conduits 10 assists in the transporting of transmitting medium 4 from chamber 1 into chamber 2, since the terminal ends of the respective conduits lie inwardly of the terminal ends of their surrounding passageways.

Both the cold and the hot gaseous media are supplied to the respective beds of transmitting media as aforedescribed at a relatively high velocity of about 40 to 50 m/s. And, conduits 5 as well as conduits 10 are evenly distributed (FIG. 3) over the width of the chambers so as to maintain an even fluidization of the transmitting media in the chambers. The heat exchange apparatus according to the invention is tight so that no leakage of gas or air occurs, the heat exchanger has no moving parts and the apparatus is highly economical since the transmitting medium 4, 7 is inexpensive. A reliable construction and operation is thus made possible and a tightly constructed apparatus is achieved.

The present heat exchanger operates, as can be seen, as transmitting media circulates between chamber 1 and chamber 2 and vice versa. The present apparatus withstands a supply of gas at high temperatures, and the construction of the present heat exchanger may be varied without affecting the scope of the invention. For example, the heat exchanger may be built in modules. Also, the transmitting medium may be in the form of stone, glass or steel spheres or any other similar material capable of withstanding heat, or may comprise sand, so long as the transmitting medium is maintained floating to obtain the so-called fluidized bed. The temperature of the fluidizing material in the respective beds can be maintained at about 200° C. However, this is only an example of the values which may prevail for the present heat exchanger.

Obviously, many modifications and variations of the present invention are made possible in the light of the above teachings. It is therefore to be understood that within the scope of the appended claims, the invention may be practiced otherwise than as specifically described.

I claim:

1. A heat exchanger for transmitting heat between gaseous media, comprising, means defining at least two adjacent chambers each partially filled with a solid transmitting medium in the form of pellets, granules or sand, at least one first conduit for the injection of a first gaseous medium of a predetermined temperature into a first of said chambers at the bottom thereof, at least one second conduit for the injection of a second gaseous medium of a temperature higher than said predetermined temperature into a second of said chambers at the bottom thereof, means on said first chamber associated with said second conduit and opening into said second chamber, means on said second chamber associated with said first conduit and opening into said first chamber, both said opening means thereby establishing communication between said chambers, said first and second gaseous media being injected at a rate for effecting fluidized beds of said transmitting medium in said chambers, the outlet end of said first conduit lying inwardly adjacent the terminal end of said second chamber means which opens into said first chamber for producing an ejector effect of said first gaseous medium into said first chamber, and the outlet end of said second conduit lying inwardly adjacent the terminal end of said first chamber means which opens into said second chamber for producing an ejector effect of said second gaseous medium into said second chamber, whereby said transmitting medium is transported from said first to said second chamber and from said second to said first chamber, respectively, by the ejector effects of said first and second gaseous media to thereby effect an increase in temperature of said first medium and a decrease in temperature of said second medium while passing through said transmitting media.

2. The heat exchanger according to claim 1, where in both said opening means lie at said bottoms of said chambers and respectively surround said conduits.

3. The heat exchanger according to claim 2, wherein said conduits lie adjacent one another in a common plane.

* * * * *